US006468360B1

(12) United States Patent
Andrews

(10) Patent No.: US 6,468,360 B1
(45) Date of Patent: Oct. 22, 2002

(54) METHOD FOR CLEANING DUCTWORK

(76) Inventor: Benjamin Edward Andrews, 513 Bonsack Ct., Chesapeake, VA (US) 23322

( * ) Notice: Subject to any disclaimer, the term of this patent is extended or adjusted under 35 U.S.C. 154(b) by 192 days.

(21) Appl. No.: 09/627,388

(22) Filed: Jul. 28, 2000

(51) Int. Cl.[7] ..... B24C 1/00

(52) U.S. Cl. ..... 134/8; 134/22.1; 134/22.11; 134/22.12; 15/406

(58) Field of Search ..... 134/8, 21, 22.1, 134/22.11, 22.12, 24; 15/405, 406; 451/91, 92, 94, 102

(56) References Cited

U.S. PATENT DOCUMENTS 4,038,786 A * 8/1977 Fong ..... 451/102
4,482,392 A * 11/1984 Pollock et al. ..... 134/39
5,108,512 A * 4/1992 Goffnett et al. ..... 134/7
5,123,207 A * 6/1992 Gillis et al. ..... 451/89
5,679,062 A * 10/1997 Goenka ..... 451/102
5,733,174 A * 3/1998 Bingham et al. ..... 451/102
5,785,581 A * 7/1998 Settles ..... 451/39
5,910,042 A * 6/1999 Niechcial ..... 451/39

FOREIGN PATENT DOCUMENTS

WO WO 99/22909 * 5/1999 ..... B24C/7/00

* cited by examiner

*Primary Examiner*—Randy Gulakowski
*Assistant Examiner*—J. Smetans
(74) *Attorney, Agent, or Firm*—Kaufman & Canoles

(57) ABSTRACT

This invention includes systems and methods for cleaning ventilation ducts using a dry ice blasting system that is adapted to blast debris from the interior surfaces of ventilation ducts. This invention employs either existing or artificial duct ventilation airflow to evacuate dislodged debris and a filter or filtration system attached to the ventilation system to capture the dislodged debris.

13 Claims, No Drawings

METHOD FOR CLEANING DUCTWORK

BACKGROUND OF THE INVENTION

1. Field of the Invention

This invention relates to a method for cleaning heating, ventilating, and air-conditioning (HVAC) ducting.

2. Description of Related Art

In structures and/or vessels having ducted air ventilation systems, it is well known that during normal operation, debris will collect and be deposited in the ducts. These deposits can often include such contaminants as dirt, dust, hair, clothing fibers, grease, oil, left-over construction materials, decaying organic matter and various organisms such as dust mites, bacteria, fungus, viruses, or pollen.

Not only does this debris represent a health hazard to individuals who breathe the air from the ducts but it also contributes to conditions such as allergies, asthma, or respiratory disorders. The collection and deposit of excessive amounts of debris within a particular ventilation system affects the efficiency of the ventilation system. Furthermore, large amounts of dirt, grease, oil, or lint can result in ventilation duct fires, which are extremely difficult to extinguish.

Therefore, in order to minimize health and other hazards, and to ensure efficient airflow, it is necessary for ventilation ducts to be cleaned periodically to remove the deposited debris. However, if a particular ventilation system has not been cleaned for quite some time or if the debris consists of, for example, grease or oil, the deposits of debris inside the ventilation ducts may be quite difficult to remove.

Although ventilation ducts can be cleaned by hand using various brushes, scrapers, and chemicals to remove any accumulated debris, hand cleaning is time consuming and in most cases requires that the ventilation system be dismantled, cleaned, and reassembled. Thus, various apparatuses and methods have been developed over the years for removing deposited debris from ventilation ducts. These debris removal apparatuses have traditionally used one of two methods to clean ventilation ducts. The first method employs a mechanical means to remove the deposited debris. For example, Franklin, Jr., et al. (U.S. Pat. No. 4,792,363) discloses a vent cleaning system that includes a brush that is rotated by a flexible shaft that is concentrically disposed in a flexible tubular vacuum conduit, so that dust can be dislodged from a vent wall and vacuumed into the vacuum conduit. Likewise, U.S. Pat. No. 1,869,730 to Antle, U.S. Pat. No. 5,572,766 to Matsuura et al., and U.S. Pat. No. 5,655,256 to Hendrix et al. also disclose the use of brushes to clean ventilation ducts.

The second method that has traditionally been used to remove deposited debris from ventilation ducts has utilized either compresses air or fluid. Piguillet (U.S. Pat. No. 5,942,044), for example, discloses a method for cleaning and treating a ventilation duct wherein a nozzle is propelled by the reaction thrust of a pressurized fluid emitted from several hollow arms of a propelling device.

In Jones (U.S. Pat. No. 5,966,773), a duct cleaning system is disclosed that includes an air compressor connected to a manifold with at least one line coupled to an air gun while another line is connected to the duct cleaning system providing a pressurized exhaust to dislodge and remove debris from the ducts. Likewise, U.S. Pat. No. 5,003,998 to Collett, U.S. Pat. No. 4,968,333 to Ellis et al., and U.S. Pat. No. 4,468,835 to Rhodes also use compressed air and various nozzles to clean deposited debris from ducts.

Similarly, U.S. Pat. No. 4,508,577 to Conn, et al., U.S. Pat. No. 4,141,753 to Creed, and U.S. Pat. No. 5,383,975 to Faxon disclose a fluid or pressurized medium emitting apparatus and method for cleaning material from the inside of ducts or conduit.

It has been recognized that solid Carbon Dioxide ($CO_2$), or "dry ice", can be used as a "sandblasting" medium. For example, U.S. Pat. No. 4,038,786 to Fong discloses the use of pellets of material capable of subliming under conditions of use in a sandblasting process. Unlike other sandblasting medium, which present the possibility of atmospheric contamination and must be collected or cleaned up after being used, dry ice particles disappear as gaseous carbon dioxide after having been used in sandblasting.

Therefore, the use of dry ice in sandblasting presents no cleanup problems with respect to the sandblasting medium and there is no risk of adverse atmospheric contamination because ambient air already contains carbon dioxide and carbon dioxide gas is readily dispersed within ambient air.

SUMMARY OF THE INVENTION

Although a variety of methods and apparatuses do exist for cleaning ventilation ducts, no particular system has received widespread acceptance. The known systems and methods are quite complex, and require the use of either various blowers or blower modules to provide a pressurized exhaust or strong vacuum devices to remove the debris from the ventilation ducts once the debris has been dislodged from the duct surfaces. Often, a duct-cleaning contractor must operate vacuum equipment, such as, for example, vacuum equipment located in the contractor's truck or van, in order to remove the loosened debris.

Hand cleaning, as well as certain chemical or mechanical methods of duct cleaning, can damage the ventilation ducts by scratching, wearing away, grinding down, or corroding the interior surfaces of the ventilation ducts. Unfortunately, scratches can provide areas for debris to cling to as the ventilation system operates, and any damage to the ventilation ducts will degrade the structural integrity of the ventilation ducts.

Additionally, the traditional duct cleaning systems and methods lack the ability to effectively and efficiently clean certain duct areas, such as, comers or areas around screw heads or rivets. Likewise, many of the known systems and methods are difficult to adapt for cleaning ventilation systems that are made up of both round cross sections (typically found in hot air delivery portions) and rectangular cross sections (typically found in cold air return portions).

Furthermore, when a fluid is used to dislodge the debris from a duct surface, the dislodged debris becomes mixed with the fluid and both the dislodged debris and any remaining fluid must be removed from the duct system before the system can be operated.

Accordingly, this invention provides a method for cleaning ventilation ducts that uses dry ice blasting to remove debris from the surface of the ventilation ducts.

In various exemplary embodiments, this invention separately provides a method for cleaning ventilation ducts that uses an existing ventilation system to provide sufficient vacuum power for removing dislodged dirt and debris from ventilation duct work.

In various exemplary embodiments, this invention separately provides a method for cleaning ventilation ducts that eliminates the need for additional vacuum apparatuses.

This invention separately provides a method for cleaning ventilation ducts that allows ventilation ducts to be cleaned without being completely dismantled or removed.

This invention separately provides a method for cleaning ventilation ducts that removes debris from ducts without compromising the structural integrity of the ventilation system.

This invention separately provides a method for cleaning ventilation ducts that allows debris to be removed from all of the surfaces of the ventilation system, including comers and the areas around screw heads and rivets.

In accordance with the systems and methods of this invention, one exemplary embodiment of the systems and methods for cleaning ventilation ducts according to this invention uses a dry ice blasting system that is adapted to blast debris from the surfaces of ventilation ducts. Basic dry ice blasting systems are well known as described above. The method of this invention further includes the use of existing duct ventilation airflow to evacuate dislodged debris and a filtration system attached to the exhaust of the existing duct ventilation to capture the dislodged debris.

These and other features and advantages of this invention are described in or are apparent from the following detailed description of the exemplary embodiments.

DETAILED DESCRIPTION OF THE PREFERRED EMBODIMENT

For simplicity and clarification, the operating principles, design factors, and layout of the ventilation duct cleaning systems and methods according to this invention are explained with reference an exemplary embodiment of the ventilation duct cleaning systems and methods according to this invention. The basic explanation of the operation of the ventilation duct cleaning systems and methods is applicable for the understanding and design of the constituent components employed in the ventilation duct cleaning systems and methods of this invention.

Furthermore, it should be appreciated that, for simplicity and clarification, the embodiments of this invention will be described with reference to the ventilation duct cleaning systems and methods as they operate to clean generic ventilation ducts. However, the systems and methods of this invention can be implemented in any ventilation duct, such as, for example, ventilation ducts found in aircraft, buildings, ships, submersibles, or any other vehicle or structure that employs a heating, ventilating, air-conditioning, or exhaust system.

It should be appreciated that the term "dry ice" is for basic explanation and understanding of the operation of the duct cleaning systems and methods of this invention. Therefore, the term "dry ice" is not to be construed as limiting the duct cleaning systems and methods of this invention and any material or combination of materials capable of sublimation upon impact can be used without departing from the spirit and scope of the invention.

The method of cleaning ventilation ducts and ductwork will now be set forth.

As an optional preliminary step, the air supply registers in the portion of the ventilation system that is to be cleaned are covered or closed to prevent dislodged debris from escaping from the ventilation ducts into the environment.

Then, a filter is placed in the exhaust path, preferably over any exhaust outlets of the ventilation system that is to be cleaned. Thus, any debris that is dislodged in the ventilation duct cleaning process can be captured within the debris filter and will not be discharged into the surrounding atmosphere. The particular filter that is employed to filter the ventilation system exhaust is based on the type and size of debris that is to be removed and will be predicable to those skilled in the art.

Next, at least a section of an interior portion of the ventilation duct system is accessed to provide a present access position. In various exemplary embodiments, the ventilation duct system is assessed by removing at least one access or maintenance panel in the ventilation duct system. Alternatively, access to the interior portion or the ventilation duct system is gained by cutting at least one access opening in the ventilation duct.

In various exemplary embodiments, the accessed portion of the ventilation duct system is isolated from the remaining portions of the ventilation duct system. Methods and apparatuses for isolating certain portions of a ventilation duct system, such as, for example, through the use of inflatable bags or balloons, are known to those skilled in the art.

Once at least a section of the ventilation duct system is accessed, the existing ventilation, or airflow, system is activated to provide at least a directed airflow in at least the accessed portion of the ventilation system. In various exemplary embodiments, additional airflow enabling devices, such as blowers, fans, or the like, are used to substitute or supplement the directed airflow created by the existing ventilation system.

Then, a dry ice blasting unit, such as, for example, the RDS 1000 D by COLD JET®, is used to supply dry ice particles to a specially designed blast nozzle, such as, for example, the COLD JET® 200 series LP Sonic Series, 205BL. The dry ice blaster is then used to dislodge debris from at least an area of the ventilation duct that is accessible from the accessed area of the ventilation duct. Appropriate dry ice blasting techniques are similar to known sandblasting techniques and will be understood by those skilled in the art.

In various exemplary embodiments, the dry ice blaster is supplied with 150–400 $ft^3$/min of compressed air at 45–200 psig of pressure. Furthermore, in various exemplary embodiments, the dry ice particles are supplied to the dry ice blaster at a rate of 50–200 lb/h.

Additionally, in various exemplary embodiments, the compressed air supplied to the dry ice blaster is filtered and dried to a dew point of not more than 4° C.

It should be understood, however, that these air flow rates, pressures, dry ice pellet supply rates, and dew point ranges are exemplary, and can be modified for any given duct cleaning application.

The specific blasting pressure and air flow used in the duct cleaning method of this invention will vary depending on the type of debris that is to be removed from a given duct and the desired blasting aggression. If, for example, the debris is difficult to remove or a faster debris removal rate is desired, the blasting pressure can be increased. On the other hand, if, for example, the duct material itself is weak or brittle, the blasting pressure can be lowered so that the debris can be dislodged without compromising the integrity of the duct.

During the blasting process, when the blasted dry ice particles impact debris on a surface of the ventilation duct, the dry ice dislodges the debris from the surface of the ventilation duct. Then, when the dry ice particles impact the surface of the ventilation duct, the dry ice particles sublimate. This sublimation not only transforms the dry ice particles directly from a solid to a gas, but also releases kinetic energy stored in the dry ice particles to dislodge remaining debris from the surface of the ventilation duct.

Once debris is dislodged from the surface of the ventilation duct, the debris is carried by the directed airflow that has been created as described above. The directed airflow moves the dislodged debris through the ventilation system, towards the exhaust, and eventually from the ventilation system into the filter.

When the portion of the ventilation duct that is accessible from the present access position has been satisfactorily cleaned, any removed access panels are replaced. If access to the ventilation duct system was gained by cutting an access opening in the ventilation duct, an access panel is installed over the access opening. In this manner, subsequent cleanings of the ventilation duct system can be accomplished more efficiently, as appropriate access locations have already been created.

After an access panel has been placed over the present access position, another section of the interior portion of the ventilation duct system is accessed, as described above, and the newly accessed portion of the duct system is cleaned, as further described above. In various exemplary embodiments, the ventilation duct system is accessed at least once every six to ten feet to provide sufficient access the ventilation duct to ensure proper cleaning of the ventilation duct system.

This method of cleaning accessible portions of the ventilation duct system is repeated until all of the selected ventilation duct portions have been accessed and cleaned.

While this invention has been described in conjunction with the exemplary embodiment outlined above, it is evident that many alternatives, modifications and variations will be apparent to those skilled in the art. Accordingly, the exemplary embodiment of the invention, as set forth above, is intended to be illustrative, not limiting. Various changes may be made without departing from the spirit and scope of the invention.

What is claimed is:

1. A method of cleaning a ventilation system of a ship, comprising:

accessing at least a portion of an interior of a ventilation duct;

placing a filtering means in an airflow path of the ventilation duct that includes an accessed portion of the ventilation duct;

creating a directional airflow in at least the accessed portion of the ventilation system;

blasting debris in at least the accessed portion of the ventilation duct with particles of a material capable of subliming after engaging a surface of the ventilation duct until at least a portion of the debris is dislodged; and allowing dislodged debris to move through the ventilation system by the force of the directional airflow and engage the filtering means.

2. The method of claim 1, wherein creating a directional airflow in at least an accessed portion of the ventilation system includes activating the ventilation system.

3. The method of claim 1, wherein creating a directional airflow in at least an accessed portion of the ventilation system includes activating an additional airflow enabling means.

4. The method of claim 1, wherein creating a directional airflow in at least an accessed portion of the ventilation system includes activating both the ventilation system and an additional airflow enabling means.

5. The method of claim 1, wherein the material capable of subliming after engaging a surface of the ventilation duct comprises solid carbon dioxide.

6. The method of claim 1, wherein blasting the debris includes blasting at a pressure of 45–200 pounds per square inch gauge.

7. The method of claim 1, wherein accessing at least a portion of the interior of a ventilation duct includes removing at least one ventilation duct access panel.

8. The method of claim 7, further comprising the step of blasting debris from the at least one removed ventilation duct access panel with particles of a material capable of subliming after engaging a surface of the removed ventilation duct access panel until at least a portion of the debris is dislodged.

9. The method of claim 1, wherein accessing at least a portion of a ventilation duct includes cutting an access hole in the ventilation duct.

10. The method of claim 9, further comprising the step of installing a ventilation duct access panel over the access hole in the ventilation duct after at least a portion of the debris is dislodged from the ventilation duct.

11. The method of claim 1, further comprising the step of covering at least one ventilation duct air return prior to creating a directional airflow in at least the accessed portion of the ventilation system.

12. The method of claim 1, further comprising the step of closing at least one ventilation duct air return prior to creating a directional airflow in at least the accessed portion of the ventilation system.

13. The method of claim 1, further comprising the step of isolating the accessed portion of the ventilation system from a remaining portion of the ventilation system.

* * * * *